US005368201A

United States Patent [19]

Fuchs

[11] Patent Number: 5,368,201

[45] Date of Patent: Nov. 29, 1994

[54] PRESSURE-OPERABLE LOCKING VALVE FOR MEDIA DISPENSER

[75] Inventor: Karl-Heinz Fuchs, Radolfzell, Germany

[73] Assignee: Ing. Erich Pfeiffer GmbH & Co. KG, Radolfzell, Germany

[21] Appl. No.: 934,617

[22] PCT Filed: Dec. 21, 1990

[86] PCT No.: PCT/EP90/02280

§ 371 Date: Aug. 24, 1992

§ 102(e) Date: Aug. 24, 1992

[87] PCT Pub. No.: WO91/13281

PCT Pub. Date: Sep. 5, 1991

[30] Foreign Application Priority Data

Feb. 22, 1990 [DE] Germany ..... 4005528

[51] Int. Cl.[5] ..... B67D 5/64

[52] U.S. Cl. ..... 222/162; 222/320; 222/386

[58] Field of Search ..... 222/162, 319, 320, 321, 222/495, 499, 493, 153, 386, 340, 387; 604/214, 218, 220, 230, 231, 236, 184

[56] References Cited

U.S. PATENT DOCUMENTS

| | | | |
|---|---|---|---|
| 2,574,744 | 11/1951 | Koepke | 222/531 |
| 3,344,963 | 10/1967 | Wynes et al. | 222/495 |
| 3,907,174 | 9/1975 | Steiman | 222/383 |
| 3,908,870 | 9/1975 | Nozawa et al. | 222/321 |
| 4,022,354 | 5/1977 | Kotuby | 222/321 |
| 4,154,374 | 5/1979 | Kirk, Jr. | 222/325 |
| 4,440,325 | 4/1984 | Treuhaft et al. | 222/402.14 |
| 4,728,008 | 3/1988 | Graf et al. | 222/321 |
| 4,856,677 | 8/1989 | Brunet et al. | 222/321 |
| 4,921,142 | 5/1990 | Graf et al. | 222/162 |
| 4,946,069 | 8/1990 | Fuchs | 222/321 |
| 5,024,355 | 6/1991 | Jouillat et al. | 222/162 |

FOREIGN PATENT DOCUMENTS

| | | |
|---|---|---|
| 2719242 | 11/1977 | Germany . |
| 3421071 | 12/1984 | Germany . |
| 3513575 | 10/1986 | Germany . |
| 3631341 | 4/1987 | Germany . |
| 3909031 | 9/1990 | Germany . |
| 2076076 | 11/1981 | United Kingdom . |

*Primary Examiner*—Andres Kashnikow
*Assistant Examiner*—Philippe Derakshani
*Attorney, Agent, or Firm*—Quarles & Brady

[57] ABSTRACT

A valve for a dispenser has a spherical valve body which is fixed in the closed position by a catch mechanism. When a predetermined dispensing pressure is applied, the valve body is moved out of the locked position and displaced, like a piston, into a sealed receiving chamber, in which it is fixed. This results in a very simple, reliable closure of the outlet channel, which only needs to be opened once.

27 Claims, 3 Drawing Sheets

PRESSURE-OPERABLE LOCKING VALVE FOR MEDIA DISPENSER

BACKGROUND AND SUMMARY OF THE INVENTION

The invention relates to a dispenser for various flowable media, which can be in gaseous, liquid, pasty, or pulverulent form.

According to the invention, the dispenser has a pressure chamber connected by an outlet channel to a dispensing opening, such as a nozzle, and/or at least one valve, which can be an inlet valve, an outlet valve or some other valve, so that operation can be reliably controlled.

A further problem of the invention is to avoid the disadvantages of known constructions and, in particular, to obtain a high positional security or a very reliable closure by the particular valve.

This problem is solved in that at least one valve is fixed in at least one position, particularly in the closed position, by at least one restraint in the manner of a snap-action holding and release mechanism or the like, so that in the case of an open position it is immovable or in the case of a closed position the valve can be held in such a way that the restraint can only be overcome by applying a predetermined disengaging force and then it occurs suddenly, so as to pass into from one operating state to another operating state.

Appropriately a catch is formed to operate directly by the contact between a valve body and a valve seat. For the accurate, simple determination of the locking force, the valve body is axially or symmetrically constructed. The valve body can be inserted as a closed standard component in a jacket having a channel portion. The jacket forms a valve seat along the channel portion.

The restraint or catch can also be produced by a fluid, against which the valve operates when transferred between two positions under pressure changes. This leads to a type of fluid suspension or damping. For example, the valve body can restrict or block a pressure chamber that is pressurized by a gas or air introduced into a bore portion connected to the valve seat. By changing the conditions between two portions of the pressure chamber associated with the two valve positions, it is possible to adjust the restraining force.

The fluid pressure can also act as a restoring spring for restoring the valve to at least one position, particularly the closed position.

Particularly when the dispenser is constructed as a one-way and/or disposable dispenser, so that the total stored medium volume is substantially completely discharged following a complete pump stroke, the valve as an outlet valve can also merely form a hermetically tight closure of the medium or pump chamber in the vicinity of the outlet channel. Under the pumping pressure, this closure is transferred into its open position, where it is secured by a jamming, locking or stop engagement. The valve construction is particularly suitable for dispensers in accordance with German Patent Application DE-OS 35 32 890, to which reference should be made for further details and effects.

Particularly if the dispenser is constructed according to the inventor's German Patent Application P 39 09 031.0, assigned to the assignee of the present invention, to which reference should be made, it can be advantageous to form a displacement or valve body mechanically connected to a pump cylinder by a separate component, which is made from a different material than the cylinder and is connected thereto, e.g. by means of a fixed connecting member. Therefore, the cylinder can then be constructed in a simple manner as a container made from glass or a material having similar characteristics. A material such as glass would be too inelastic for use as the valve or displacement body. The more elastic displacement body forms, together with the hard glass container, a closed standard component.

These and other features of the invention will be apparent from the disclosure provided by the claims, the description and the drawings, which follow. In the description, reference is made to the accompanying drawings, which form a part hereof, and which illustrate examples of the invention. Such examples, however, are not exhaustive of the various embodiments of the invention and, therefore, reference is made to the claims which follow the description for determining the scope of the invention.

DETAILED DESCRIPTION OF THE PREFERRED EMBODIMENTS

Figure 1:
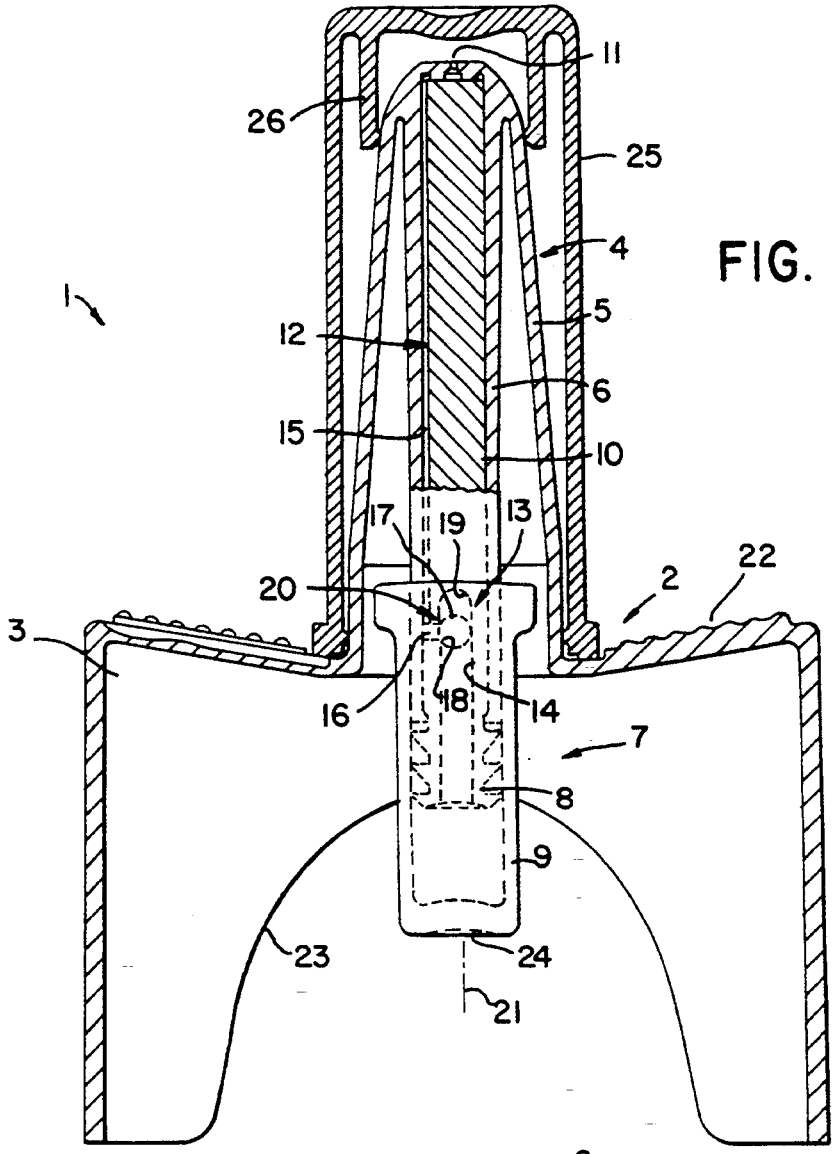
FIG. 1 is an axial section view of a preferred embodiment of the invention.
Figure 2:
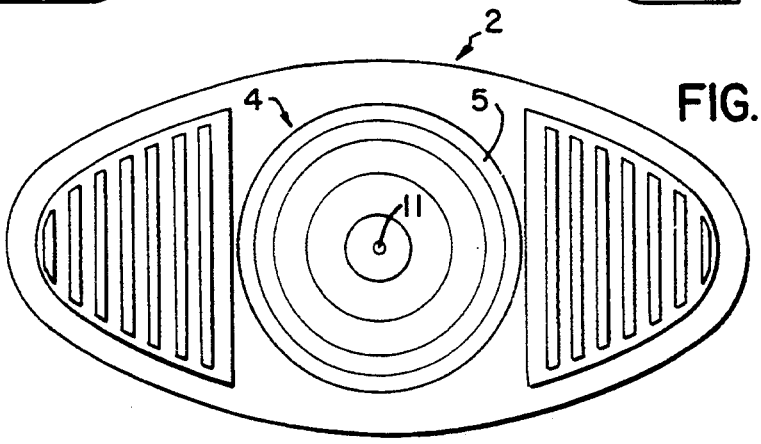
FIG. 2 is a plan view of the dispenser according to FIG. 1 with the closure cap removed.
Figure 3:
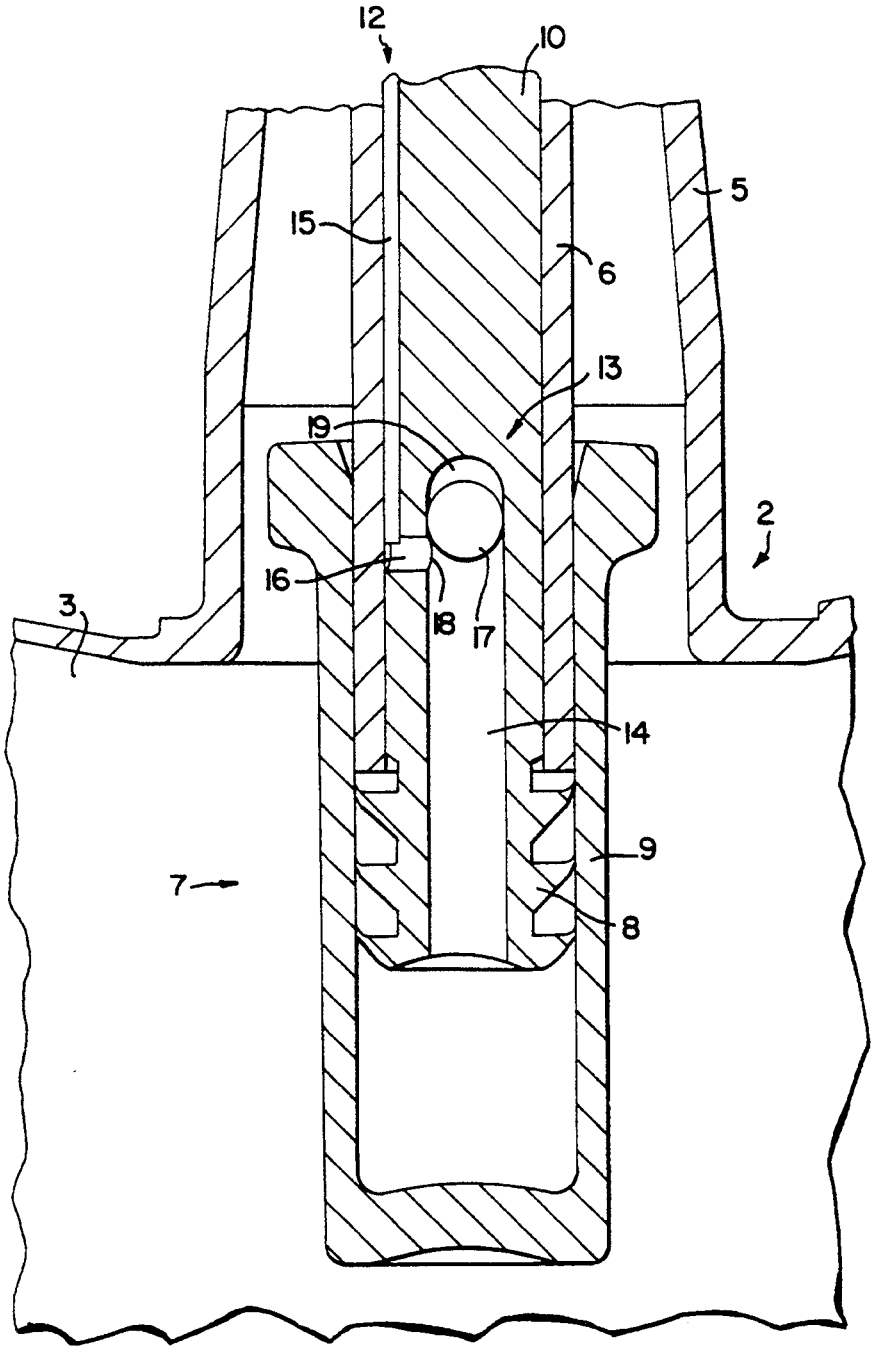
FIG. 3 is a detail view of the embodiment of FIG. 1 on a larger scale and in a valve-open position.

The dispenser 1 according to FIGS. 1–3 has a one-piece basic body 2 substantially forming its entire outer boundary and also has at one end a cap-like casing 3, which is flat-oval in a longitudinal view, together with a connecting piece 4 projecting from its end wall over the outside. The connecting piece 4 is formed by an outer sleeve 5 connected to an inner sleeve 6 by one end to the end wall of the casing 3 in the vicinity of the free end to the outer sleeve 5. Otherwise the outer sleeve 5 is separated by a space from the inner sleeve 6, which is located in substantially contact-free manner within the outer sleeve 5, and projects inside of the cap end wall into the casing 3.

At this lower end, the inner sleeve 6 carries a thrust piston pump 7 located substantially completely within the casing 3 and the outer sleeve 5 and which substantially comprises a piston 8 and a cup-shaped cylinder 9 closed in one piece at the bottom. The cylinder 9 and the piston 8 define a pump chamber that is hermetically sealed. The piston 8 has several, cross-sectionally saw-tooth-like piston lips that engage the inside walls of the cylinder 9. The piston 8 is connected to the associated end of the inner sleeve 6 and projects into the cylinder 9. The piston 8 is constructed in one piece with a substantially through, cylindrical piston shaft 10, which extends up to the inner end of a dispensing opening 11. The dispensing opening 11 is provided at the free end of the connecting piece 4 in the end wall of a nozzle cap, which is formed by the transition area between the two sleeves 5, 6 and on whose end wall the piston shaft 10 is connected with an end facing away from the piston 8.

From the pressure 19 chamber an outlet channel 12 passes through the piston 8 and along the outer circumference of the piston shaft 10 into a twisting device located at one end of the piston shaft 10 and from there roughly radially inwards directly into the dispensing opening 11. The outlet channel 12 is completely within the piston shaft 10 with the piston 8 and the cylinder 9 in the starting position. The inner sleeve 6 is provided as an outlet valve 13, which in the starting position forms a tight closure.

A channel 14 is constructed as a blind bore that leads into the piston shaft 10. The piston shaft 10 is connected at a distance from the blind bore via a transverse channel 16 to a channel portion 15, which runs along the associated portion of the piston shaft 10 between its outer circumference and the inner circumference of the inner sleeve 6 up to the twisting device. The inner end of channel 14, which is circular in axial view of the transverse channel 16, and which is located in the cylindrical jacket of the channel portion 14, forms a ring-like valve seat 18. The valve seat 18 is located on an imaginary spherical surface for a valve body 17, which is spherically curved at least on its outer surface, The valve body 17 is preferably completely spherical with a sphere radius that is slightly larger than that of the valve seat 18 or the radius of the channel portion 14. The valve body 17 is pressed through the channel portion 14 to to slightly pretensioned engagement on the valve seat 18, and is supported in the jacket area of the channel portion 14 opposite the valve seat 18. The valve body 17 is then located a distance from the bottom of the blind bore at least corresponding to its outer diameter.

A reception chamber 19, also referred to as pressure chamber 19, is formed for the body 17, and is completely sealed with respect to the outlet channel 12, the channel portion 14 and the transverse channel 16 by the valve body 17. The controlled movement of the valve body 17 is in roughly in the same direction as, or is an extension of, the assembly insertion direction, without it being necessary to have a separate securing member against dropping out or a valve spring.

As soon as a sufficiently high pressure has been produced by manual displacement of the pump cylinder 9 with respect to the pump piston 8 in the pump chamber and the channel portion 14, the resilient position restraint 20 of the valve body 17 formed by the described construction is overcome and then in the manner of a valve piston it rolls and/or slides out of the valve seat 18 and according to FIG. 3 is pressed into the reception chamber 19. The volume of the reception chamber 19 can be made large enough to ensure that its gas filling offers no significant resistance to the opening movement of the valve body 17, or the reception chamber 19 can for this purpose be provided with a suitable vent. Substantially all said components are appropriately located along a common central axis 21.

The external diameter of the inner sleeve 6, at least in the vicinity of the cylinder 9, corresponds to the internal diameter, so that the cylinder 9 is guided in a substantially clearance or tilt-free manner on the inner sleeve 6. Moreover, as a result, the outer circumference of the inner sleeve 6 in the vicinity of the valve 13 is indirectly supported by the piston shaft 10, which is sleeve-like in this area, in radial manner on the cylinder wall. At least in the vicinity of the valve body 17 or the valve seat 18, the piston shaft 10 is made from pressure-elastic, resilient material, whereas the inner sleeve 6 is made from much harder material. The valve body 17 can be shape-hard or pressure-elastic.

On either side of the connecting piece 4 the end wall of the casing 3 forms an operating handle 22 in the form of pressure surfaces for the finger. In the flatter walls of the casing jacket there are two facing, approximately identical and aligned cutouts 23 for the simultaneous engagement of a thumb, ,which emanate from the end of the casing jacket 3 open to full width and accessible by the handle 24 provided as a finger pressure surface on the cylinder 9 and which is formed by the bottom of the cylinder 9. During operation, the cylinder 9 engages only the piston 8 and the inner sleeve 6 and is otherwise free of contact within the basic body 2 when inserted in the outer sleeve 5.

The connecting piece 4 can be substantially completely located in a removable cap 25, which extends approximately up to the end wall of the casing 3 and is sealed by an associated end that engages the outer circumference of the outer sleeve 5. A further seal is provided closer to the nozzle cap and is formed by an inner muff 26 projecting freely from the inside of the cap end wall. The muff 26 engages a torus on the outer face of the connecting piece 4. Thus, the dispensing opening 11 is located in a relatively small, separate cap chamber. The outer end of the otherwise contact-free cap 25 is accurately centered with respect to the associated end of the connecting piece 4.

Figure 4:
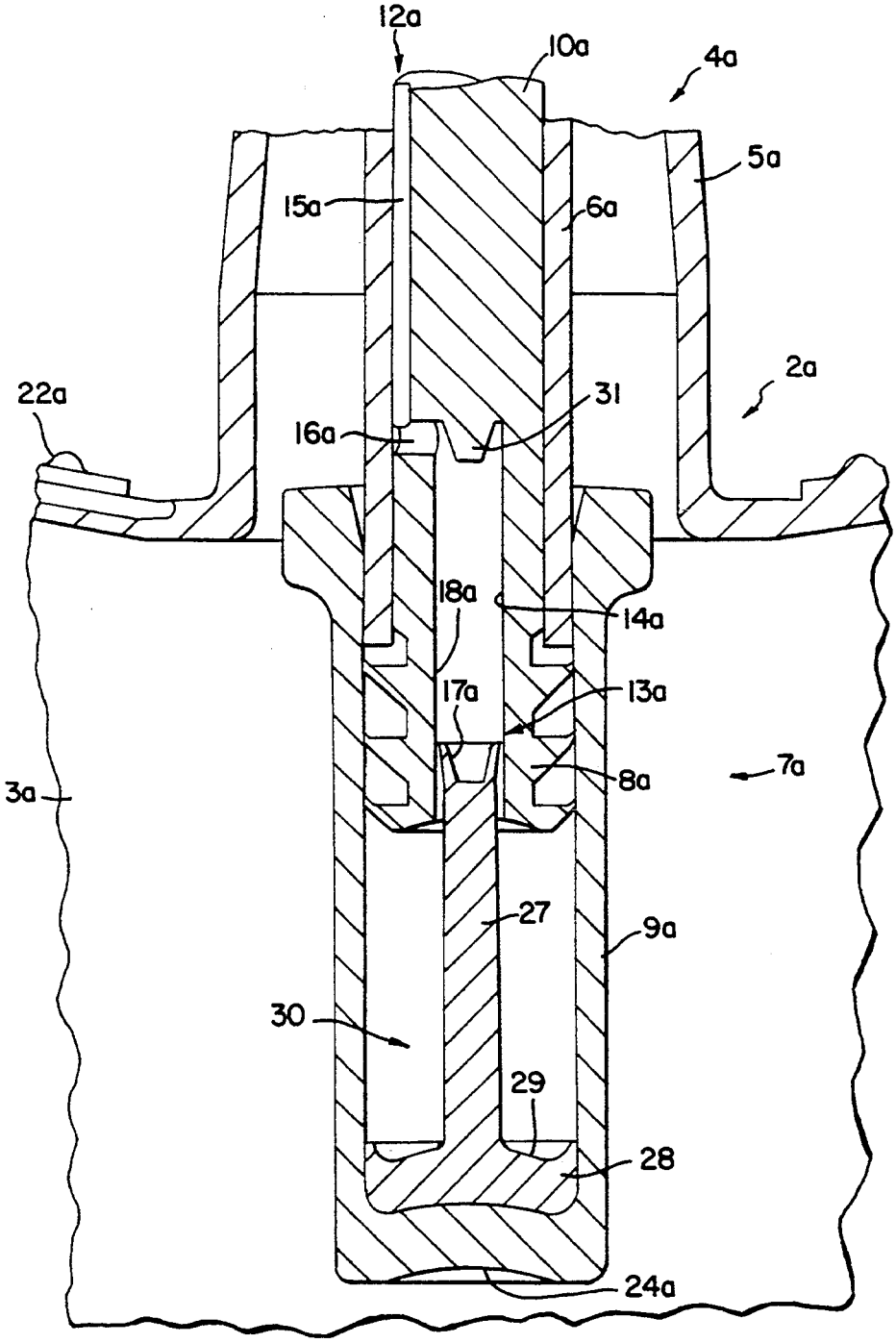
FIG. 4 is another embodiment in a view corresponding to FIG. 3.

In FIG. 4, corresponding parts carry the same reference numerals as in FIGS. 1–3, but followed by the letter "a", so that the description correspondingly applies for said embodiment. As from the starting position the channel portion **14*a* contains a valve rod 17*a* located at the end of a shaft 27 in the form of a cup sleeve or ring lip. The valve body 17*a* is stretched and constricted in a radial direction. The valve body 17*a* and the shaft form a displacement body, which at the end of the pump stroke fills the channel portion 14*a*** almost completely except for a narrow annular gap.

At its end remote from the valve body **17*a*, the shaft 27 is constructed in one piece with a widened collar 28, which is appropriately inserted with pressure from the open end in the cylinder 9*a*** and engages approximately the whole inside surface of the cylinder bottom.

Thus, the collar 28 forms the annular bottom boundary of the pump chamber facing the piston **8*a*. The component 30 having the displacement body can be inserted or not in the cylinder 9*a*, so that the same cylinder can be differently equipped as required. On its end face, the valve body 17*a* forms a depression or a sleeve inner chamber conically widened in the movement direction and in which, at the end of the pumpstroke, is inserted displacement shoulder 31 which is reciprocally shaped relative to the valve body 17*a* and which projects from the blind bore bottom of the channel portion 14*a* against the valve body 17*a***.

Adjacent to the jacket of the displacement shoulder 31 or directly connected to the blind bore bottom is provided the transverse channel **16*a*, so that the medium displaced from the valve body 17*a* at the end of the pump stroke is forced directly into the transverse channel 16*a* in a final volume spurt. The bottom boundary 29 is adapted to the spherically hollowed out, associated end face of the pump piston 8*a*** and to the frustum-shaped jacket from its front piston lip, so that here again complete emptying takes place.

I claim:

1. A dispenser for discharging media comprising:

a valve body operable in a valve channel between a first operating state and a second operating state, and wherein snap-action holding and release means are positioned in said valve channel for retentively holding said valve body in at least one of said first operating state and said second operating state against transfer to another of said first operating state and said second operating state, one of said first operating state and said second operating state comprising a positively locked state of said valve; and wherein said snap-action holding and release means is releasable as a function of a pressure of the media.

2. The dispenser according to claim 1, wherein said snap-action holding and release means are operational to release said valve body from said locked state.

3. The dispenser according to claim 2, wherein said snap-action holding and release means includes a holding force on said valve body that is releasable by applying a predetermined release force for overcoming said holding force on said valve body and transferring said valve body from said first operating state to said second operating state in a sudden release motion when freed from said holding force.

4. The dispenser according to claim 1, wherein for holding said valve body in said at least one locked state, said snap-action holding and release means provides a resilient holding force, said holding force being overcomable by an operationally applicable release force for freeing said valve body from said locked state.

5. The dispenser according to claim 1, wherein said snap-action holding and release means includes locking means having a locking reception and a locking counter member engaging said locking reception in said locked state, said snap-action holding and release means has a first operating state and a second operating state corresponding with said first operating state and said second operating state for said valve body.

6. The dispenser according to claim 5, further comprising a jacket which forms a motion surface separate from said locking reception, said motion surface being penetrated by said locking reception, and wherein with respect to said locking reception, said counter member is movable along said motion surface.

7. The dispenser according to claim 6, wherein said motion surface is an operationally deformable wall, and said locking reception forms an annular seat for said counter member.

8. The dispenser according to claim 6, wherein in said locked state, said counter member engages said locking reception with pretension.

9. The dispenser according to claim 6, wherein in at least one of said operating states said counter member is displaceably clamped in a seat by being pressed in said seat, and said counter member is supported on a surface opposing said locking reception.

10. The dispenser according to claim 5, wherein said counter member is inserted into said first operating state in an insertion motion, an operating motion of said counter member from said first operating state to said second operating state defines a continuation of said insertion motion, said insertion motion and said operating motion are substantially oriented in a common direction.

11. The dispenser according to claim 1, wherein means are provided for releasing said valve from said positively locked state by a rolling motion.

12. The dispenser according to claim 1, wherein said valve body is transferable from said first operating state to said second operating state through a control motion, and wherein spring means are provided for acting counter to said control motion.

13. The dispenser according to claim 1, wherein said valve body is transferable from said first operating state to said second operating state through a control motion, and wherein damping means are provided for damping said control motion.

14. The dispenser according to claim 1, wherein a pressure chamber is provided, said snap-action holding and release means constricting said pressure chamber when being transferred from said first operating state to said second operating state.

15. The dispenser according to claim 14, wherein said pressure chamber is provided by a blind bore.

16. The dispenser according to claim 1, wherein said locked state is a closed state of said valve body.

17. The dispenser according to claim 1, wherein in said locked state, said valve body provides a discharge closure of said dispenser, further comprising means for positively holding said valve body when transferred to said second operating state.

18. The dispenser according to claim 1, wherein said snap-action holding and release means directly engages said valve body.

19. The dispenser according to claim 8, wherein said valve body provides a counter member of said snap-action holding and release means and said valve seat provides a locking reception of said snap-action holding and release means.

20. The dispenser according to claim 19, wherein said counter member is provided in a media duct connected to a transverse duct, said transverse duct providing said locking reception.

21. The dispenser according to claim 1, wherein said dispenser provides a thrust piston pump having a piston unit and a pump cylinder, said piston unit being traversed by an outlet duct for the media and including a pump piston and a piston shaft, said valve body having an outlet valve provided inside said outlet duct.

22. A dispenser for discharging media comprising:

a valve body operable in a valve channel between a first operating state and a second operating state, and wherein snap-action holding and release means are positioned in said valve channel for retentively holding said valve body in at least one of said first operating state and said second operating state against transfer to another of said first operating state and said second operating state, one of said first operating state and said second operating state comprising a positively locked state of said valve, said snap-action holding and release means including locking means having a locking reception and a locking counter member engaging said locking reception in said locked state, said snap-action holding and release means having a first operating state and a second operating state corresponding with said first operating state and said second operating state for said valve body;

wherein said counter member has a curved surface on an external circumference; and wherein said curved surface is spherical.

23. The dispenser according to claim 21, wherein said counter member is a ball.

24. The dispenser according to claim 1, wherein said dispenser provides a single stored volume of the media, said dispenser being provided for substantially entirely expelling the stored volume upon one single operating stroke, said dispenser being cup-shaped and being hermetically sealingly closed, said valve providing a tight closure in said locked state.

25. A dispenser for discharging media, comprising:

an outlet duct forming an outlet channel for the media, an insert rod operationally displaceably engaging inside said outlet channel, and a medium pressure chamber, wherein said insert rod is a component separate from said medium pressure chamber, said insert rod being fixedly connected to said medium pressure chamber wherein said insert rod forms a depression on one end, and wherein said outlet duct forms a displacement projection for insertion into said depression at an end of a pump stroke of said dispenser.

26. The dispenser according to claim 25, wherein said dispenser is operational from an initial state to an end state of a pump stroke, in said end state said insert rod substantially entirely filling said duct section, a pressure chamber being provided by a container having a closed bottom, said insert rod having a connecting member press-fitted to said container, said connecting member providing a bottom boundary of said pressure chamber and opposing a pump piston, opposing surfaces of said pump piston and said connecting member being reciprocally adapted so as to permit complete emptying of said pressure chamber from the media between said opposing surfaces.

27. The dispenser according to claim 25, wherein said displacement projection provides a jacket, a transverse duct being provided directly adjacent to said jacket, thereby providing means for forcing the media out of said depression and directly into said transverse duct at said end of said pump stroke.

* * * * *

UNITED STATES PATENT AND TRADEMARK OFFICE

CERTIFICATE OF CORRECTION

PATENT NO. : 5,368,201

DATED : November 29, 1994

INVENTOR(S) : Fuchs

It is certified that error appears in the above-indentified patent and that said Letters Patent is hereby corrected as shown below:

| | |
|---|---|
| Col. 3, line 20 | Delete the comma and insert a period. |
| Col. 5, line 16 | "claim 2" should be --claim 1--. |
| Col. 6, line 35 | "claim 8" should be --claim 18--. |
| Col. 7, line 25 | Add --,-- after "chamber''. |

Signed and Sealed this

Twenty-third Day of May, 1995

*Attest:*

Bruce Lehman

BRUCE LEHMAN

*Attesting Officer*

*Commissioner of Patents and Trademarks*